United States Patent [19]

Moinard et al.

[11] 4,094,161

[45] June 13, 1978

[54] SUBMERGED APPARATUS AND METHOD FOR SUBMERSING THE SAME

[75] Inventors: Michel Moinard, Bizanos; Michel Leturcq, Rueil Malmaison; Catherine Delcroix, Puteaux, all of France

[73] Assignee: Societe Nationale Elf Aquitaine, Paris, France

[21] Appl. No.: 684,086

[22] Filed: May 7, 1976

[30] Foreign Application Priority Data

May 7, 1975 France ..... 75 14447

[51] Int. Cl.[2] ..... E02D 23/02

[52] U.S. Cl. ..... 61/95; 61/96; 9/8 P

[58] Field of Search ..... 61/101, 95, 86, 87, 61/88, 93; 9/8 P

[56] References Cited

U.S. PATENT DOCUMENTS

| | | | |
|---|---|---|---|
| 3,522,709 | 8/1970 | Vilain | 61/95 |
| 3,553,969 | 1/1971 | Chamberlin et al. | 61/101 |
| 3,641,774 | 2/1972 | Hekkanen et al. | 61/96 |
| 3,670,515 | 6/1972 | Lloyd | 61/95 |
| 3,720,066 | 3/1973 | Vilain | 61/95 |
| 3,798,915 | 3/1974 | Burkhardt | 61/101 |
| 3,855,809 | 12/1974 | Westling | 61/101 |
| 3,859,806 | 1/1975 | Guy et al. | 61/96 |

*Primary Examiner*—Jacob Shapiro

*Attorney, Agent, or Firm*—Lane, Aitken, Dunner & Ziems

[57] ABSTRACT

In a method of immersion of a massive part such as a hydrocarbon storage tank on the ocean floor, the storage tank is placed over the immersion site, then lowered by means of ballast floats so that the top of the tank is close to the surface of the water. The lower end of a first rigid column also fitted with ballast floats is attached to the tank and pivotally displaced from a horizontal position at the surface of the water to a totally submerged vertical position. A number of columns are attached successively in end-to-end relation and pivotally displaced until the storage tank reaches the ocean floor.

10 Claims, 6 Drawing Figures

FIG. 2
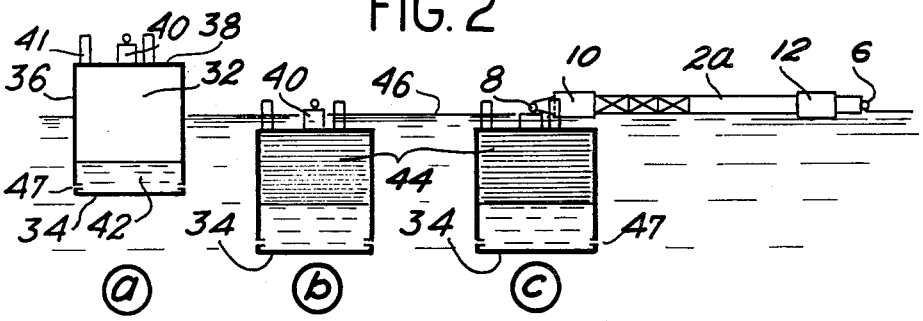
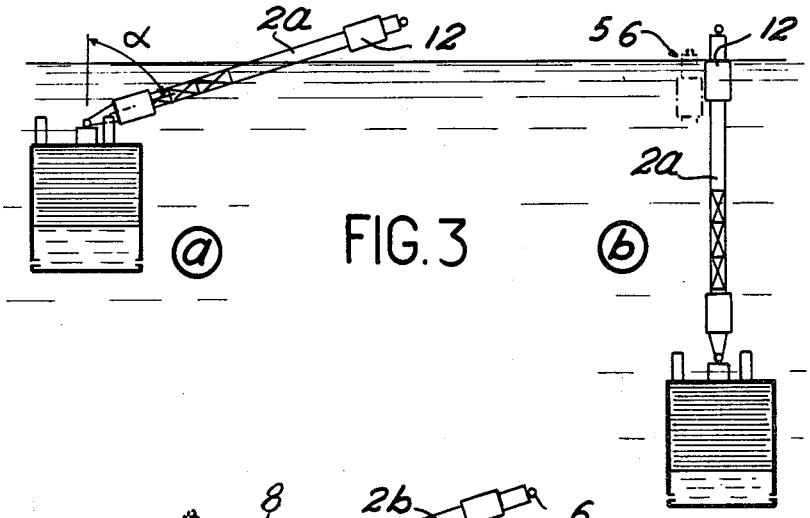
FIG. 3
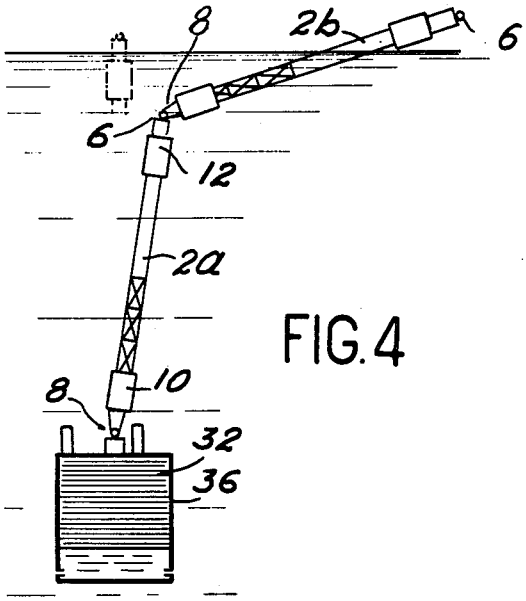
FIG. 4

SUBMERGED APPARATUS AND METHOD FOR SUBMERSING THE SAME

This invention relates to a method of immersion of massive parts and to the immersed structure obtained as a result of the practical application of said method.

In more exact terms, the present invention is concerned with a method in which a massive part can be submerged so as to rest on the ocean floor while being guided during its immersion.

In particular, said massive part can be a tank for the storage of hydrocarbons.

It is known that the immersion of a hydrocarbon storage tank gives rise to major difficulties, especially when said tank has a substantial volume. In particular, the tank must be well guided during the immersion operation in order to ensure that the laying of the tank on the ocean floor takes place exactly at the desired point and can be controlled at each moment. Moreover, there are many risks of overturning of the storage tank, especially when this latter has a large volume.

In addition, it must be made possible to stop the raising or lowering of the storage tank at any moment in order to deal with any unexpected occurrence.

The precise aim of the present invention is to provide a method for the immersion of massive parts and in particular of a tank for the storage of hydrocarbons which overcomes the disadvantages mentioned in the foregoing.

The method of immersion of a massive part on an ocean bed essentially comprises the following steps:

- said massive part is brought into position above the immersion site after being fitted with ballastable floats,
- action is produced on said ballasts in order to sink said part in such a manner that the top portion thereof is in the vicinity of the surface of the water,
- the lower end of a first rigid column fitted with floats which perform the function of ballasts is fixed on the massive part and action is produced on said ballasts of said massive part and/or of said column in order to cause the sinking of the part and a pivotal displacement of the column and in order to bring said column into a vertical position until the upper extremity of said column is brought level with the surface of the water,
- a plurality of columns are attached successively to the upper extremity of the first column until said massive part attains the sea bed.

Preferably, the first column is attached to the massive part and the columns are attached to each other by means of members which permit of free pivotal motion of one of the elements with respect to the element which is attached thereto.

In accordance with another characteristic feature, the rigid columns can have a metallic trelliswork structure.

In the event that the massive part is a storage tank, each column is fitted with a section of internal or external duct extending over the full length of each column, each duct section being provided with means for connecting said section to adjacent duct sections of said adjacent column or columns.

The present invention is also concerned with the submerged structure which is obtained as a result of the practical application of the method and which makes it possible to provide a continuous articulated connection between the submerged storage tank and a platform which emerges above the level of the water.

The submerged structure aforesaid comprises a hydrocarbon storage tank equipped with means for maintaining the pressure existing within the storage tank at a value substantially equal to the pressure which prevails in the vicinity of said storage tank, said tank being intended to rest on the sea bed, and a plurality of rigid columns pivotally coupled to each other, the column located at the greatest depth being connected to said storage tank and the top portion of the uppermost column being intended to emerge above the surface of the water and to comprise at least one platform, each column being provided with ballasts and with one duct section, said duct sections being connected to each other so as to constitute a continuous duct between said storage tank and said platform.

A more complete understanding of the invention will in any case be obtained from the following description of one mode of application of the method which is given by way of example and not in any sense by way of limitation, reference being made to the accompanying drawings, in which:

FIGS. 2 to 6 illustrate the different phases of positioning of a storage tank and of the columns.

Figure 1:
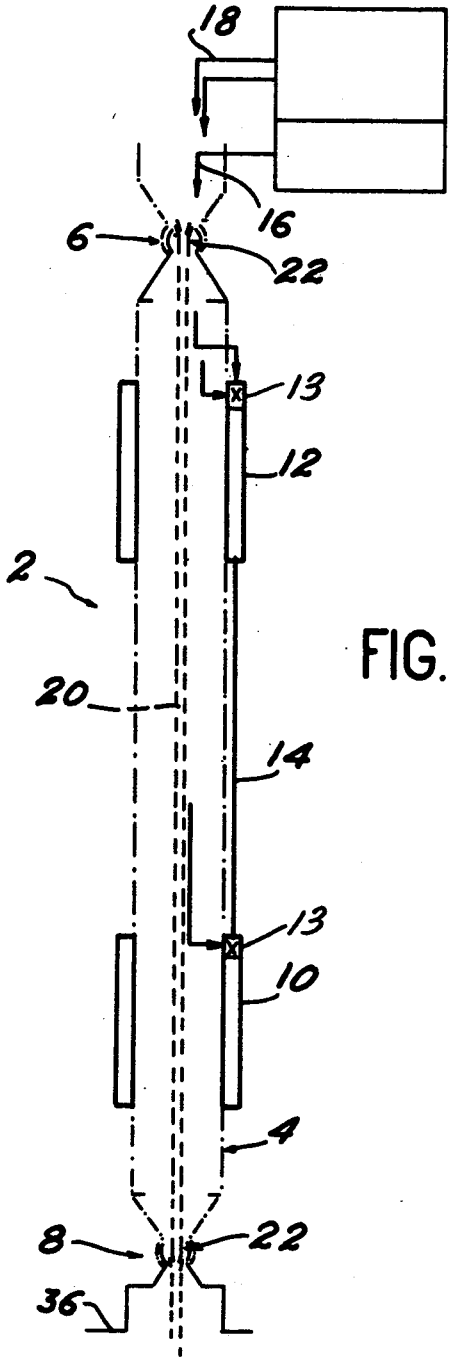
FIG. 1 illustrates one form of construction of an immersion column.

There is shown in FIG. 1 a preferred form of construction of a rigid column for the practical application of the method. The column which is generally designated by the reference 2 is constituted by a cylindrical shell 4 of metallic trelliswork construction. The cylindrical shell 4 has an upper end-fitting provided with a coupling member 6 of known design, for example of the knuckle-joint type. Similarly, provision is made at the lower end of said shell for a second end-fitting provided with a coupling member 8 which is capable of cooperating with the coupling member 6. The column is also provided with two floats 10 and 12 each having the shape of a torus. Said floats are fixed on the shell and perform the function of ballasts. Provision can be made within the floats for radial internal partitions in order to prevent rotational displacements of the column when this latter is moved into position over the immersion site. A pipe 14 fitted with a valve serves to establish a connection between the two floats. The upper float is fitted with a pipe 16 for the injection of gas under pressure in order to regulate the quantity of water within the floats. Closable orifices such as the orifice 13 are also formed in the floats in order to adjust the quantity of water contained in these latter. Opening of said orifices is remotely controlled by means of electric cables 18. Said cables can also serve to provide a connection with instruments for checking apparent weight.

Finally, the column 2 is preferably provided along its axis with a duct 20 for the flow of hydrocarbons. The duct 20 is provided at each end with a connector 22 which serves to connect the ducts 20 of the different columns to each other.

FIG. 2*a* illustrates the storage tank 32 in the position in which this latter is towed by a ship.

By way of example, said tank has the shape of a cylinder with a vertical axis. In actual practice, the diameter of said cylinder can be considerably greater with respect to its height than is shown in the figure. The storage tank is of course constituted by a bottom wall 34, a side wall 36 and a cover 38. The central portion of the cover 38 is provided with a coupling member 40 and one or a number of floating columns 41 which make it possible to improve the stability of the storage tank at the moment of immersion. The tank has a portion 42 which forms a ballast and is filled with water during transportation whilst the remainder of the tank is empty.

FIG. 2*b* illustrates the first stage of the method of immersion which consists for example in filling the storage tank with a liquid which is lighter than water and is designated by the reference 44. This introduction of liquid makes it possible to reduce the apparent weight of the storage tank to zero or practically to zero.

During the different immersion stages which will be described hereinafter, this nullification of the apparent weight can take place continuously or in successive steps. There is therefore a continuous connection (not shown in the figures) between an enclosure for the storage of said liquid above the level 46 of the sea and the storage tank.

The floating column or columns serve to support the storage tank during the stage of connection of the first column 2*a*.

During the different immersion stages, there is maintained within the tank a pressure equal to the pressure existing in the water which surrounds the storage tank. This result can be obtained by means of the closable orifices 47 formed in the wall of the storage tank.

In the following stage, a first column 2*a* is brought into position in proximity to the storage tank.

In the next stage shown in FIG. 3*a*, the column 2*a* is displaced in pivotal motion from its horizontal position in FIG. 2*c* to a vertical position shown in FIG. 3*b*.

This pivotal displacement is obtained by producing action conjointly on the ballasts of the column 2*a* and of the storage tank 32 and in particular by opening the valve of the pipe 14, thus permitting the water contained in the float 12 to flow towards the float 10.

On completion of the pivotal motion which naturally accompanies a downward displacement of the storage tank, the situation is again the same as in FIG. 3*b*; in other words the upper end of the column 2*a* emerges above the surface of the water in the vicinity of the level of the top ballast 12.

In the following stage, action is again produced on the ballasts in order to bring the top portion of the column into the position shown in dashed lines and designated by the reference 56.

A second column 2*b* which is of the same type as the column 2*a* is brought into position in proximity to the upper end of said column 2*a*.

There is shown in FIG. 4 a further stage of immersion of the storage tank which consists in securing the second column 2*b* to the upper end of the first column 2*a*.

The second column just mentioned is also provided with pivotal coupling devices. The operation carried out with the column 2*b* takes place in the same manner as the operation described in connection with the first column 2*a*.

The pivotal coupling members preferably comprise a pivotal articulation which is fixed on the column or on the storage tank; the free end of the pivotal articulation is provided with a coupling member and this latter is capable of cooperating with a corresponding coupling member which is rigidly fixed to the column or to the storage tank. These pivotal coupling members can be of the type described in the French certificate of Addition No. 96,425 filed in the name of the present Applicant on Nov. 20, 1968.

The platform can also comprise means for treatment of the hydrocarbons or the waste waters contained in the storage tank. In particular, this treatment may be intended to remove the traces of water contained in the hydrocarbon.

Figure 6:
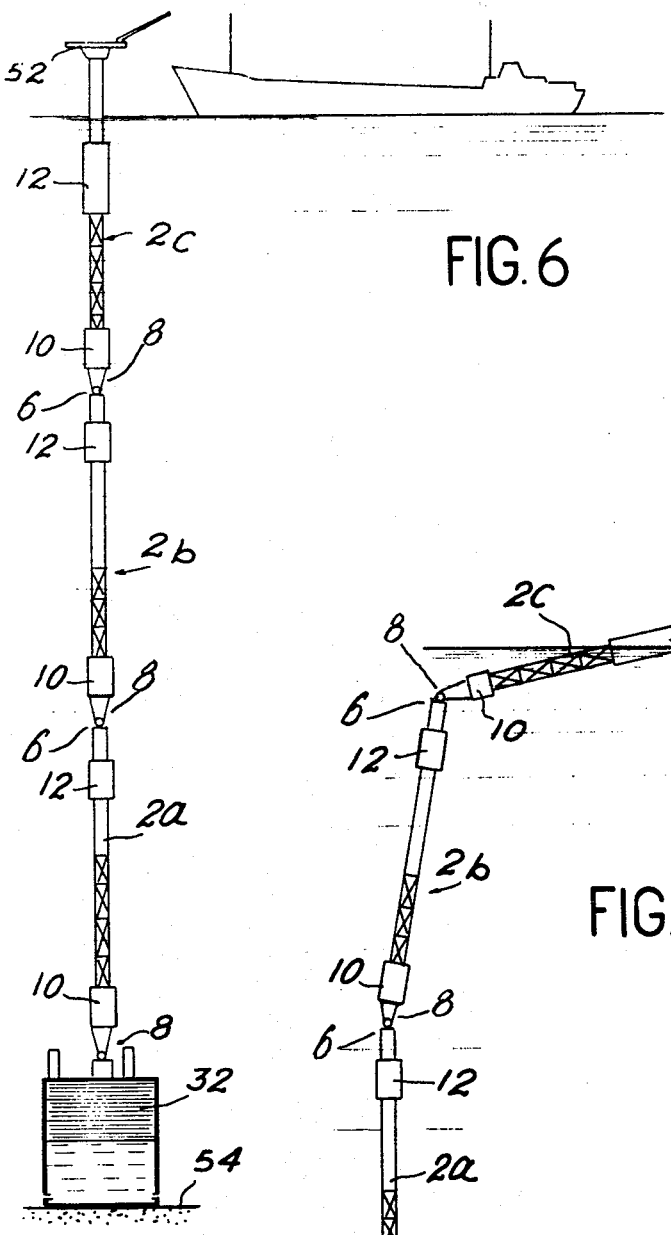
Figure 5:
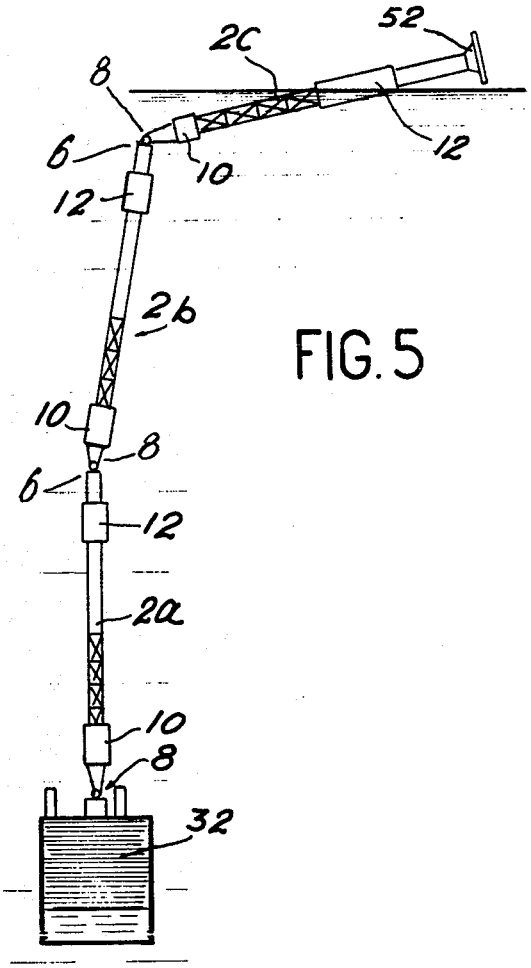

The column 2*c* mentioned earlier is placed in position in the same manner as the column 2*b* and, after pivotal displacement, is located in the position shown in FIG. 6.

The total height of the three columns is adjusted so as to ensure that, after pivotal displacement of the last column 2*c*, the bottom wall of the storage tank 2 rests on the sea bed 54.

As can readily be understood, the number of columns required in this example of construction is not given in any limiting sense and it is apparent that this number of columns must simply be sufficient to equal the intended depth of immersion below the surface of the sea. This number is therefore dependent on the one hand on the immersion depth and on the other hand on the height to be given to each column.

During all the immersion operations, the apparent weight is checked and the admission of water into the ballasts or the discharge of water from these latter is controlled from a servicing ship.

It is also readily apparent that each column can advantageously have sections of piping over the entire length of the column, said sections being provided with pipe connections at the level of each coupling member so as to obtain a continuous pipe from the storage tank 32 to the platform 52.

Said columns can also be fitted with all desirable cables for devices which serve to detect or check the level of hydrocarbons contained in the storage tank or for any other function.

What we claim is:

1. A method for submersing and positioning a structure in a body of water through a series of separate and consecutive submersion stages so as to cause said structure to come to rest on the floor of said body of water, said method comprising the steps of:

(a) separately bringing to a location near the surface of the body of water above the submersion site said structure and a plurality of columns having several float means for ballast, said structure and columns being unattached to one another;

(b) positioning said structure which includes ballast means above the submersion site;

(c) acting on the ballast means of said structure in order to submerge said structure until its top is near the surface of the body of water and the apparent weight of said structure is reduced to about zero;

(d) pivotally attaching the top of said submerged structure to one end of a first of said plurality of columns;

(e) acting on the float means of said first column for pivotally displacing said attached one end of said first column downward until the column is brought into a vertical, submerged position in the water with the other end of said first column being close to the surface of the body of water, said structure being further submerged vertically downward at the submersion site by the pivotal displacement of said first column;

(f) pivotally attaching said other end of the first submerged column near the surface of the water to one end of a second column;

(g) acting on the float means of said second column for pivotally displacing said attached one end of said second column downward until the second column is brought into a vertical, submerged position in the water with the other end of said second column being close to the surface of the body of water, said structure and said first column being further submerged vertically downward at the submersion site by the pivotal displacement of said second column; and (h) maintaining the pressure within said structure at a value substantially equal to the pressure of the water surrounding said structure during each successive submersion stage.

2. A method according to claim 1, wherein the steps of pivotally attaching and displacing said first and second columns are successively repeated with additional columns until said structure comes to rest on the floor of the body of water.

3. A method according to claim 2, wherein each of said columns is rigid and has a metallic trelliswork construction.

4. A method according to claim 2, wherein the ballast means of the structure comprises the structure itself and means for introducing into said structure a liquid which is lighter than water.

5. A method according to claim 2, wherein the structure is a storage tank utilized for storing hydrocarbons.

6. A method according to claim 5, wherein each of said columns is provided with a duct extending along the length of said columns from one end to the other, said duct being provided at each end thereof with means for connection with the duct of an adjoining column.

7. A method according to claim 2, wherein the apparent weight of said structure and said columns is reduced to about zero.

8. A method according to claim 2, wherein the step of acting on the float means of each column comprises permitting a liquid to flow from a first of said float means to a second of said float means.

9. A submerged storage apparatus comprising:

(a) a storage tank provided with means for maintaining the pressure within said storage tank at a value substantially equal to the pressure of the water surrounding said tank, said tank resting on the floor of a body of water, and (b) a plurality of rigid columns pivotally connected to each other, the column located at the greatest depth being connected to said storage tank, the uppermost column emerging above the surface of the body of water, and being provided with a platform, each column being provided with float means and with a duct, said ducts being connected to each other so as to constitute a continuous duct between said tank and said platform.

10. A submerged structure according to claim 9, wherein said float means comprise at least two spaced ballasts, each of said ballasts being adapted to receive fluid to affect the floating action of said column, and means for selectively distributing said fluid between said two ballasts.

* * * * *

UNITED STATES PATENT AND TRADEMARK OFFICE

CERTIFICATE OF CORRECTION

PATENT NO. : 4,094,161

DATED : June 13, 1978

INVENTOR(S) : Michel Moinard, et al

It is certified that error appears in the above-identified patent and that said Letters Patent are hereby corrected as shown below:

Page 1, line marked [73], the assignee should be -- Societe Nationale Elf Aquitaine (Production) -- and not "Societe Nationale Elf Aquitaine".

Signed and Sealed this

*Eighth* Day of *May 1979*

[SEAL]

*Attest:*

RUTH C. MASON
*Attesting Officer*

DONALD W. BANNER
*Commissioner of Patents and Trademarks*